US007661509B2

(12) United States Patent
Dadd

(10) Patent No.: US 7,661,509 B2
(45) Date of Patent: Feb. 16, 2010

(54) DEVICES FOR REGULATING PRESSURE AND FLOW PULSES

(76) Inventor: Paul M. Dadd, 7443 Harding St., Mentor, OH (US) 44060

( * ) Notice: Subject to any disclaimer, the term of this patent is extended or adjusted under 35 U.S.C. 154(b) by 1027 days.

(21) Appl. No.: 10/890,775

(22) Filed: Jul. 14, 2004

(65) Prior Publication Data

US 2005/0011700 A1 Jan. 20, 2005

Related U.S. Application Data

(60) Provisional application No. 60/487,404, filed on Jul. 14, 2003.

(51) Int. Cl.
*F01N 1/12* (2006.01)

(52) U.S. Cl. ..... 181/280; 181/278; 181/279

(58) Field of Classification Search ..... 181/278, 181/279, 280

See application file for complete search history.

(56) References Cited

U.S. PATENT DOCUMENTS

| | | | | |
|---|---|---|---|---|
| 1,157,256 | A | 10/1915 | Schmitt | |
| 1,612,584 | A * | 12/1926 | Hunter et al. | 181/279 |
| 1,797,310 | A | 3/1931 | Wright | |
| 2,031,451 | A | 2/1936 | Austin | |
| 2,063,270 | A * | 12/1936 | Bacchetti-Righetti | 181/280 |
| 2,359,365 | A | 10/1944 | Katcher | |
| 2,911,055 | A * | 11/1959 | Mcdonald | 181/280 |
| 3,580,357 | A | 5/1971 | Whitney | |
| 3,700,069 | A | 10/1972 | Rausch et al. | |
| 3,888,331 | A | 6/1975 | Wang | |
| 3,913,703 | A | 10/1975 | Parker | |
| 4,084,658 | A | 4/1978 | Murphy | |
| 4,167,987 | A | 9/1979 | Turner | |
| 4,317,502 | A * | 3/1982 | Harris et al. | 181/280 |
| 4,635,753 | A | 1/1987 | Itani | |
| 4,683,978 | A * | 8/1987 | Venter | 181/280 |
| 5,952,625 | A | 9/1999 | Huff | |
| 6,199,658 | B1 | 3/2001 | Huff | |
| 6,364,055 | B1 | 4/2002 | Purdy | |

FOREIGN PATENT DOCUMENTS

JP 05332121 A * 12/1993

* cited by examiner

*Primary Examiner*—Elvin G Enad
*Assistant Examiner*—Jeremy Luks
(74) *Attorney, Agent, or Firm*—Pearne & Gordon LLP

(57) ABSTRACT

Devices are provided for regulating the pressure pulses and flow pulses that are emitted in the exhausts of apparatus and equipment such as internal combustion engines, compressors and poppet valves. The pressure pulses are reflected from a reflecting member to their source as expansion waves that create a reduced pressure zone that allows subsequently emitted flow pulses to be more easily emitted, thereby enhancing the operational efficiency of the apparatus and equipment. Flow pulses that contain exhaust products such as the products of combustion from an internal combustion engine are regulated so that the exhaust flow they generate is not unduly restricted within the device and an undesirable back pressure that resists the emission of flow pulses from their source created. In regulating the pressure and flow pulses, the devices attenuate the noise generated by the pressure and flow pulses.

37 Claims, 2 Drawing Sheets

DEVICES FOR REGULATING PRESSURE AND FLOW PULSES

The benefit of provisional application Ser. No. 60/487,404, filed on Jul. 14, 2003, and incorporated herein by reference is claimed for this application.

The present invention relates to devices for regulating pressure pulses and flow pulses that are emitted in the exhausts of various apparatus and equipment.

BACKGROUND OF THE INVENTION

Apparatus and equipment such as, for example, internal combustion engines, compressors and poppet valves emit pressure pulses and flow pulses in their exhausts. In certain of the apparatus and equipment, such as the internal combustion engines, products of combustion comprise the flow pulses. The pressure and flow pulses are sources of noise, and the flow pulses can create a back pressure that adversely affects the operational efficiency of the apparatus and equipment.

The known exhaust systems that are employed with the aforementioned sources of pressure and flow pulses for the purpose of receiving and conveying away from the sources the pressure pulses and exhaust products that are emitted as flow pulses are varied. In many cases the designs of such exhaust systems do not adequately account for the back pressure that can be created by the flow pulses nor do the systems regulate the pressure pulses in a manner to improve the operational efficiency of the sources of the pressure pulses.

In particular, it is often the case that the known exhaust systems are intended to muffle, or attenuate, the undesirable noise generated by the operation of the sources of pressure and flow pulses. The energy of the pressure pulses is the primary source of such noise. Not only are the pressure pulses audible in and of themselves, in addition, pressure pulses reflect off obstructions and surfaces generating additional frequencies, often sinusoidal in nature, which are perceived as secondary noise. Also, should flow pulses pass over an obstruction, an intensified pressure field is formed on the upstream side of the obstruction and a reduced pressure field is formed on the downstream side of the obstruction. These pressure fields cause the generation of additional secondary noise of a generally sinusoidal nature having differing frequencies. Numerous devices are known to those skilled in the art for attenuating the secondary noise. However, the wave lengths of the secondary noise typically are such that the attenuating devices necessarily contain multiple chambers and passages, particularly where wave cancellation techniques are employed to attenuate the noise, and, as a result, are undesirably large and cumbersome. Such devices, as well as noise muffling devices that employ baffling or expansion techniques, often restrict exhaust flow by not adequately taking into account the flow pulses that are generated and, consequently, an undesirable back pressure is created at the location where the exhaust products are emitted. As a result, the operational efficiency of the source of the flow pulses is negatively affected. Additionally, the known devices do not regulate the pressure pulses in way that improves the operational efficiency of the sources of the pressure pulses.

SUMMARY OF THE INVENTION

The present invention regulates the pressure pulses and flow pulses emitted in the exhausts of apparatus and equipment of the types referred to above. Specifically, the pressure and flow pulses are directed to a reflecting member where at least a portion of each of the pressure pulses is reflected. This feature and the arrangement of other components of the device of the invention serve to attenuate the noise generated by the pressure and flow pulses. Also, because the pressure pulses are reflected as expansion waves back to the location where the pressure and flow pulses are emitted, the expansion waves create a reduced pressure zone at that location. As a result, the flow pulses can be more easily emitted from the source, thereby enhancing the operational efficiency of the source. This procedure is referred to herein as "tuning". The flow pulses are made up of the exhaust products, such as the products of combustion from an internal combustion engine, and generate an exhaust flow which, if not efficiently conveyed away from the source, will create a back pressure that will resist the emission of flow pulses from the source and adversely affect the operational efficiency of the source. The failure to efficiently convey away from the source the exhaust flow results in an increased pressure differential between the internal and external pressures of the regulating device. This pressure differential is referred to herein as "flow loss".

According to a first aspect, a device is provided in accordance with the present invention so as to be adapted for connection to a source of pressure and flow pulses and receive and regulate the pressure and flow pulses that are generated by the source. The device has an entry end with an opening therein that is adapted to be placed in fluid communication with one or more outlets in the source from which the pressure pulses and any flow pulses are emitted. The device also has an exit end with an opening therein in fluid communication with the opening in the entry end of the device so as to allow for the discharge from the device of the pressure pulses and flow pulses generated by the source after the pressure pulses and flow pulses generated by the source have passed through the device. Additionally, a reflecting member is located in the device so as to reflect at least a portion of each pressure pulse, whereby the noise generated by the pressure pulses is attenuated. According to another aspect, the reflecting member is adapted to be spaced from at least one of the one or more outlets a distance such that the at least a portion of each of the pressure pulses that is reflected by the reflecting member is reflected as an expansion wave back through the opening in the entry end of the device to the one or more outlets in the source such that the expansion wave arrives at the one or more outlets while at least a portion of a flow pulse is being emitted from the one or more outlets.

According to further aspects, the devices referred to in the previous paragraph include means defining a first passageway for a first portion of each pressure and flow pulse. The first passageway extends between the opening in the entry end of the devices and a location adjacent the opening in the exit end of the devices. The devices also include means defining at least one second passageway for a second portion of each pressure and flow pulse. The at least one second passageway extends between the opening in the entry end of the devices and a location adjacent the opening in the exit end of the devices. Additionally, the at least one second passageway is longer than the first passageway whereby the first portion of each pressure pulse that enters the first passageway arrives at the opening in the exit end of the device before any fraction of the second portion of that same pressure pulse that enters the second passageway arrives at the opening in the exit end of the device and the first portion of each flow pulse that enters the first passageway arrives at the opening in the exit end of the device before the second portion of that same flow pulse that enters the second passageway arrives at the opening in the exit end of the device. In a specific aspect, the means defining a first passageway comprises a first enclosure and the first passageway has the configuration of a cylinder. Additionally, the means defining at least one second passageway includes a second enclosure that is arranged concentrically around and spaced from the first enclosure to create an annular space between the exterior of the first enclosure and the interior of the second enclosure and means that are located in the annular space between the first and second enclosures for establishing in the annular space at least one second passageway in the form of a helical passageway. Also, the reflecting member may comprise an annulus having an outer circumference and an inner circumference. The annulus is attached along its outer circumference to the second enclosure at the exit end of the device whereby the inner circumference of the annulus comprises the opening in the exit end of the device. Various dimensional relationships may be incorporated into the devices. Specifically, the total cross-sectional area of the at least one second passageway can be approximately three times the cross-sectional area of the first passageway; the total flow area of the at least one second passageway can be approximately equal to the flow area of the first passageway; and the cross-sectional area of the first passageway can be equal to or less than the cross-sectional area of the opening in the exit end of the device. Additionally, the first passageway and the at least one second passageway may terminate and merge short of the annulus. In such a case, the first passageway and the at least one second passageway would, preferably, terminate short of the annulus by a distance at least sufficiently great so as not to impede flow from the at least one second passageway to the opening in the exit of the device.

Each of the further aspects of the invention described in the previous paragraph may also include as a modification a third enclosure that defines a third passageway that has the configuration of a truncated cone. The third passageway has a truncated end and a base end with the cross-sectional area of the base end of the third passageway being approximately equal to the cross-sectional area of the opening in the entry end of the device. The second enclosure and the third enclosure at the base end of the third passageway are connected to one another so that the base end of the third passageway adjoins the opening in the entry end of the device in a face-to-face relationship. A fourth enclosure defines a fourth passageway that has the configuration of a cylinder. One end of the fourth enclosure is connected to the third enclosure at the truncated end of the fourth passageway so that the fourth passageway and the truncated end of the third passageway adjoin one another in a face-to-face relationship. The other end of the fourth enclosure is adapted to be put into fluid communication with the source whereby the outlets in the source are placed into fluid communication with the opening in the entry end of the device. A fifth enclosure defining a fifth passageway that has the configuration of a truncated cone may also be included. The fifth passageway has a truncated end and a base end. The second enclosure and the fifth enclosure at the base end of the fifth passageway are connected to one another so that the base end of the fifth passageway adjoins the opening in the exit end of the device in a face-to-face relationship. There also may be included a sixth enclosure that defines a sixth passageway that has the configuration of a cylinder. One end of the sixth enclosure is connected to the fifth enclosure at the truncated end of the fifth passageway so that the sixth passageway and the truncated end of the fifth passageway adjoin one another in a face-to-face relationship. Dimensional relationships that may be maintained in the modification of the second aspect of the invention are as follows; the cross-sectional area of the sixth passageway may be the same as or larger than the cross-sectional area of the opening in the exit end of the device.

According to other aspects, devices as described in the third previous paragraph include means defining a first passageway for a first portion of each pressure and flow pulse. The first passageway extends from the opening in the entry end of the device to the exit end of the device and forms the opening in the exit end of the device. The devices also include means defining at least one second passageway for a second portion of each pressure and flow pulse. The at least one second passageway extends between the opening in the entry end of the device and the reflecting member. In these aspects, the reflecting member closes off entirely the at least one second passageway from the passage of pressure and flow pulses past the reflecting member. In a specific aspect, the means defining a first passageway comprises a first enclosure and the first passageway has the configuration of a cylinder. The means defining the at least one second passageway includes a second enclosure that is arranged concentrically around and is spaced from the first enclosure to create an annular space between the exterior of the first enclosure and the interior of the second enclosure and means that are located in the annular space between the first and second enclosures for establishing at least one second passageway in the form of a helical passageway in the annular space. A third enclosure that defines a third passageway having the configuration of a truncated cone that has a truncated end and a base end may be provided. The cross-sectional area of the base end of the third passageway is approximately equal to the cross-sectional area of the opening in the entry end of the device. The second enclosure and the third enclosure at the base end of the third passageway are connected to one another so that the base end of the third passageway adjoins the opening in the entry end of the device in a face-to-face relationship. A fourth enclosure that defines a fourth passageway that has the configuration of a cylinder also may be provided. One end of the fourth enclosure is connected to the third enclosure at the truncated end of the third passageway so that the fourth passageway and the truncated end of the third passageway adjoin one another in a face-to-face relationship. The other end of the fourth enclosure is adapted to be placed into fluid communication with the source whereby the outlets in the source are placed into fluid communication with the opening in the entry end of the device. Dimensionally, the cross-sectional area of the first passageway may be approximately equal to the cross-sectional area of the fourth passageway.

According to additional aspects, the devices as described in the fourth previous paragraph include a first enclosure that defines a first passageway that has the configuration of a truncated cone with a base end and a truncated end. The truncated end of the passageway comprises the opening in the entry end of the device. Additionally, the reflecting member of the device comprises an annulus that has an outer circumference and an inner circumference. The annulus is attached along its outer circumference to the enclosure at the base end of the first passageway and the inner circumference of the annulus forms the opening in the exit end of the device. The device may further include a second enclosure defining a second passageway having the configuration of a cylinder with a cross-sectional area approximately equal to the cross-sectional area of the opening in the entry end of the device. The second enclosure is connected to the entry end of the device so that the second passageway provides for fluid communication between the source and the opening in the entry end of the device. There also may be provided in that case a third enclosure defining a third passageway. The third passageway also has the configuration of a cylinder with a cross-sectional area approximately equal to the cross-sectional area of the opening in the exit end of the device. The third enclosure is connected to the inner circumference of the annulus so that the third passageway provides for fluid communication from the opening in the exit end of the device away from the device. In a particular case, the first passageway has a central axis that extends from the center of the opening in the entry end of the device to the center of the opening in the exit end of the device and the annulus is arranged at right angles around the central axis. From a dimensional standpoint, the cross-sectional area of the opening in the entry end of the device may be approximately equal to the cross-sectional area of the opening in the exit of the device and the diameter of the base end of the first passageway may be allow for the full expansion of the pressure pulses.

BRIEF DESCRIPTION OF THE DRAWINGS

The foregoing and other features of the present invention will be apparent from the description below with reference to the drawings wherein.

DETAILED DESCRIPTION OF THE INVENTION

Figure 1:
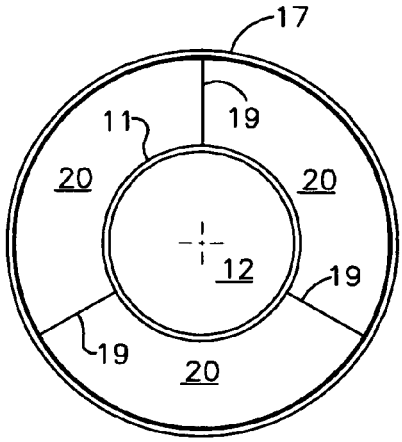
FIG. 1 is an end view a first embodiment of the invention.
Figure 2:
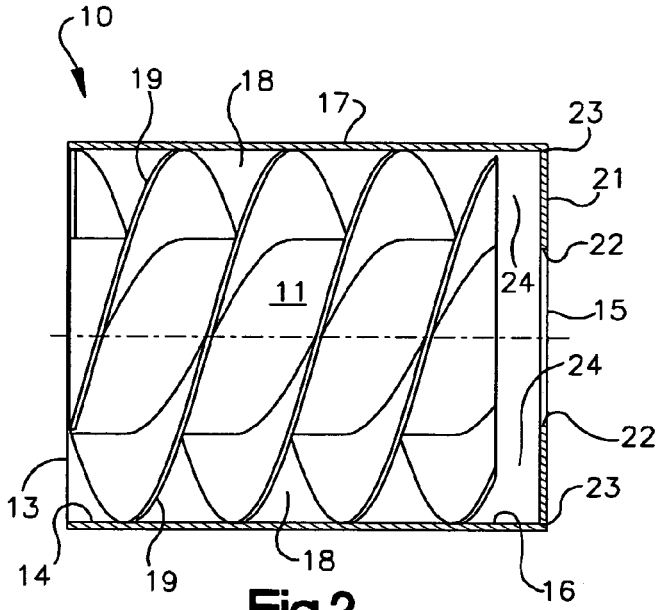
FIG. 2 is a longitudinal view, partly in section, of the embodiment of the invention shown in FIG. 1.

Referring first to FIGS. 1 and 2 of the drawings, there is shown a first embodiment of the invention that comprises a device, indicated generally at 10, that is adapted to be connected to a source of pressure pulses and flow pulses so as to receive and regulate the pressure and flow pulses generated by the source. The first embodiment of the invention and the other embodiments described below may be used with any apparatus or equipment that is a source of pressure and flow pulses such as, for example, internal combustion engines, compressors and poppet valves. However, for purposes of providing a detailed description of the several embodiments of the invention, reference is made herein to the application of the embodiments of the invention to an internal combustion engine that emits pressure pulses as well as flow pulses that contain the products of combustion, or exhaust products, that are generated in the engine as the engine burns fuel in its several cylinders.

The device 10 includes a first enclosure 11 that comprises a generally cylindrical shell and a second enclosure 17 that also comprises a generally cylindrical shell that is arranged concentrically around and is spaced from the first enclosure 11 so as to create an annular space 18 between the exterior of the first enclosure 11 and the interior of the second enclosure 17. An opening 13 in the entry end 14 of the device extends across the entire cross-sectional area that is defined by the internal diameter of the second enclosure 17. The enclosure 11 defines a first passageway 12 that extends between the opening 13 in the entry end 14 of the device and a location short of but adjacent to the opening 15 in the exit end 16 of the device. The first passageway 12 has the general configuration of a cylinder.

The entry end 14 of the device is adapted to be placed in fluid communication with one or more outlets of an internal combustion engine, not shown, from which pressure pulses and flow pulses are emitted during the operation of the engine. As will be understood by those having ordinary skill in the art, the engine will have a plurality of combustion cylinders and each will have an outlet. Pressure pulses and flow pulses that contain products of combustion are emitted through these outlets to a common exhaust port. The common exhaust port and the entry end 14 of the device are connected to one another in any suitable fashion, such as by welding, thereby placing the opening 13 in the entry end 14 of the device in fluid communication with the outlets in the engine. The opening 15 in the exit end 16 of the device is in fluid communication with the opening 13 in the entry end 14 of the device and as further explained below allows for the discharge from the device of the pressure pulses and flow pulses generated by the engine after the pressure pulses and flow pulses have passed through the device.

Means are located in the annular space 18 between the first and second enclosures 11 and 17, respectively, for establishing in the annular space at least one second passageway in the form of a helical passageway that extends between the opening 13 in the entry end 14 of the device and a location short of the opening 15 in the exit end 16 of the device. In the first embodiment of the invention illustrated in FIGS. 1 and 2, the means for establishing the at least one second passageway comprises three vanes 19, each of which is helically wound around the exterior of the cylindrical shell 11 along the entire length of the shell. Adjacent ones of the vanes 19 are spaced apart an equal distance so as to form three substantially identical helical passageways 20 in the annular space 18, each helical passageway having a length greater than the first passageway. It will be understood by those skilled in the art based on the description herein that less than or more than three vanes can be used and the passageways they form need not be identical. Further, the second or helical passageway can be formed other than by the use of vanes. For example, a pack of conduits helically wound around enclosure 11 can be used to form the second passageways. Further, it is not necessary that the second passageways be helical. It is only required that they be longer than the first passageway 12 by an amount discussed below and that they be in fluid communication with opening 13 and the reflecting member 21.

It will be understood from the foregoing description that as each pressure and flow pulse from the engine enters opening 13 a first portion of the pressure and flow pulse will enter the first passageway 12 and a second portion of the same pressure and flow pulse will enter the helical passageways 20. The first portion of each pressure and flow pulse that enters the passageway 12 will continue through passageway 12 and be discharged from the device through the opening 15 in the exit end 16 of the device. The second portion of each pressure pulse that enters the helical passageways 20 will continue through the passageways 20 until it reaches reflecting member 21. At that point, most of the second portion of each pressure pulse will be reflected from the reflecting member 21 but a fraction of the second portion of each pressure pulse will pass through gap 24 and exit the device through opening 15. The second portion of each flow pulse that enters the helical passageways 20 will continue through the passageways past reflecting member 21 through gap 24 and will exit the device through opening 15.

The reflecting member 21 located in the device comprises an annulus having an inner circumference 22 and an outer circumference 23. The annulus is attached along its outer circumference 23 to the second enclosure 17 at the end of the device in the embodiment shown in FIGS. 1 and 3, whereby the inner circumference 22 of the annulus comprises the opening 15 in the exit end 16 of the device. The reflecting member 21 serves to reflect at least a portion of each pressure pulse and, thereby, attenuate the noise generated by the pressure pulses. The portion of the pressure pulses that the reflecting member 21 reflects are reflected as expansion waves back through the helical passageways 20. Thus, as fuel is combusted in the combustion cylinders of the engine, pressure pulses and flow pulses are generated and emitted from the cylinder outlets and travel through the engine's exhaust port to the opening 13 in the entry end 14 of the device. A portion of the pressure pulses will pass through the helical passageways 20 and impinge on reflecting member 21 whereupon the pressure pulses will be reflected as expansion waves back through the helical passageways 20 and out opening 13. Where tuning of the engine is to be optimized, the reflecting member 21 is spaced from at least one of the one or more cylinder outlets in the engine a distance such that at least a portion of each of the pressure pulses that is reflected as an expansion wave back through the opening 13 in the entry end 14 of the device to the one or more outlets in the engine arrives at the one or more outlets while at least a portion of a flow pulse is being emitted from the one or more outlets. This results in the easier emission of the flow pulse, thereby tuning the engine exhaust system and enhancing the engine's operational efficiency. The precise location of the reflecting member 21 in relation to the cylinder outlets can be determined empirically or through calculations applying formulas that govern the speed of travel of the pressure pulses and the corresponding reflected expansion waves.

The flow pulses that are emitted from the engine contain the products of combustion, or exhaust products, generated by the combustion of fuel in the cylinders of the engine. These flow pulses develop an exhaust flow that must be conveyed away from the engine in a minimally restrictive fashion. Otherwise a differential pressure is created between the pressure in the device and the pressure outside the device resulting in a flow loss and a back pressure that is deleterious to efficient engine operation. The present invention effectively regulates and deals with the exhaust flow so as to minimize flow losses as explained in more detail below.

In order to achieve a collection of performance characteristics that are presently preferred insofar as (a) operational efficiency, or tuning, of the engine (b) attenuation of noise generated by the pressure and flow pulses and (c) control of flow losses are concerned, certain dimensional relationships are maintained among the various components of the first embodiment of the device of the invention. Dimensional relationships that are important in this regard are: the ratio of the internal diameter of the shell 11 to the internal diameter of the shell 17; the ratio of the diameter of the opening 15 in the exit end 16 of the device to the diameter of the passageway 12; the length of the gap, or the distance 24, between the terminating points of the first passageway 12 and the helical passageways 20 and the annulus 21; the difference between the length of the first passageway 12 and the length of the helical passageways 20; and the ratio between the flow area of the first passageway 12 and the total flow area of the helical passageways 20.

As presently preferred, the internal diameter of the shell 11 is approximately one-half the internal diameter of the shell 17. As a result, the total cross-sectional area of the helical passageways 20 is approximately three times the cross-sectional area of the first passageway 12 so that approximately 25% of the energy of a pressure pulse entering the device will travel through first passageway 12 and 75% of the energy of the pressure pulse will travel through the helical passageways 20. With this relationship and with the reflecting member 21 properly spaced from the outlets in the engine, most of the energy of the pressure pulses will be reflected back to the engine's cylinder outlets so that effective tuning of the engine can be accomplished. To the extent that tuning does occur, the reflected pressure pulse returns to opening 13 as a weaker pressure pulse. With respect to the ratio of the diameter of the opening 15 of the passageway 12, the diameter of the opening 15 is equal to or greater than the diameter of the first passageway 12 so that the cross-sectional area of the opening 15 is equal to or greater than the cross-sectional area of the first passageway. As far as the length of gap 24 is concerned, as can best be seen in FIG. 2, the helical passageways 20 and the first passageway 12 terminate and merge short of the annulus 21. The length of the gap or distance 24 between the termination of the helical passageways 20 and the first passageway 12 and the annulus 21 is such that the flow area through the gap is approximately equal to the flow area of the larger of the flow area through the first passageway 12 and the total flow area through the helical passageways 20 and is, thus, sufficiently great so as not to impede the flow of exhaust products from the helical passageways 20 to the opening 15. With respect to the relationship between the flow area of the first passageway 12 and the total flow area of the helical passageways, the vanes 19 are placed at such an angle in annular space 18 that the flow area of the first passageway 12 and the total flow area of the helical passageways 20 are equal. In other words, even thought the total cross-sectional area of the helical passageways is three times the cross-sectional area of the first passageway 12, the ability of the flow pulses to pass through the helical passageways is no greater than the ability of the flow pulses to pass through the first passageway 12. Consequently, 50% of a flow pulse will pass through helical passageways 20 and 50% will pass through first passageway 12. This is in distinction to the pressure pulses which are of a different character than the flow pulses. These latter three dimensional relationships that have been mentioned minimize flow losses in the device and the creation of back-pressure at the engine.

With respect to the lengths of the helical passageways 20 and the first passageway 12, the helical passageways are of a length, compared to the length of the first passageway, such that pressure and flow pulses are not reinforced at the exit end 16 of the device. In other words, a fraction of the 75% component of each pressure pulse reaching annulus 21 will not be reflected but will pass through gap 24 and out opening 15. By maintaining the length of the first passageway 12 shorter than the lengths of the helical passageways 20, the fraction of the 75% component of the pressure pulse passing through gap 24 will be discharged through opening 15 at a different time than the 25% component of the pressure pulse that passes directly through passageway 12. This is also the case with the flow pulses wherein about one-half of each flow pulse will pass through the helical passageways 20 and one-half will pass directly through passageway 12 because the flow areas of the helical passageways and the passageway 12 are approximately the same. Attenuation is thereby enhanced.

By maintaining the foregoing relationships as described, the tuning effect, flow losses and attenuation are optimized. It will be understood that any one of these operational characteristics can be preferentially optimized at the potential expense of one or both of the other operational characteristics if desired. For example, by decreasing to less than 1 to 1 the ratio of the diameter of the opening 15 to the internal diameter of the first passageway 12, acoustic attenuation is increased with little effect on tuning but flow losses are increased. In order to produce a collection of operational characteristics that are presently preferred, the dimensional relationships set forth above are preferred.

From the foregoing description it will be understood that the first enclosure 11 comprises a means defining a first passageway 12 for a first portion of each pressure and flow pulse, the first passageway 12 extending between the opening 13 in the entry end of the device 12 and a location adjacent the opening 15 in the exit end 16 of the device 12. It will also be understood from the description that the second enclosure 17 arranged concentrically around and spaced from the first enclosure 11 to create an annular space 18 between the exterior of the first enclosure 11 and the interior of the second enclosure 17 together with the means in the form of vanes 19 that are located in the annular space 18 between the first and second enclosures for establishing in the annular space at least one second passageway in the form of a helical passageway comprise means defining at least one second passageway extending between the opening 13 in the entry end 14 of the device and a location adjacent the opening 15 in the exit end 16 of the device. It will also be understood that at least one second passageway is longer than the first passageway, whereby the first portion of each pressure pulse that enters the first passageway arrives at the opening in the exit end of the device before any fraction of the second portion of that same pressure pulse that enters the second passageway arrives at the opening in the exit end of the device and the first portion of each flow pulse that enters the first passageway arrives at the opening in the exit end of the device before the second portion of that same flow pulse that enters the second passageway arrives at the opening in the exit end of the device.

Figure 3:
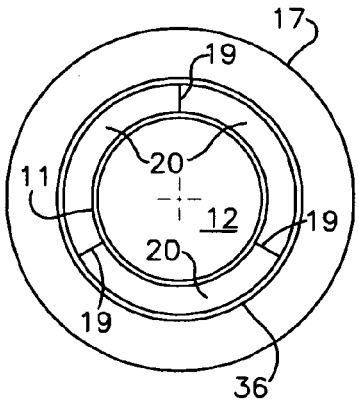
FIG. 3 is an end view of a second embodiment of the invention.
Figure 4:
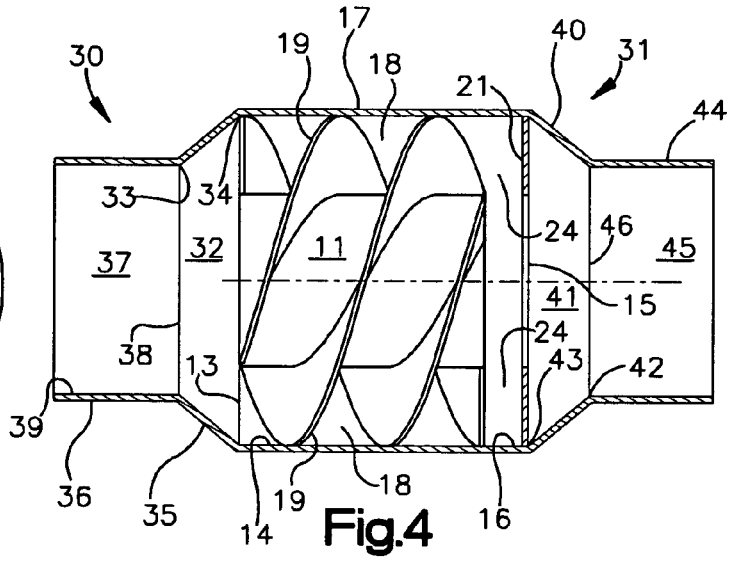
FIG. 4 is a longitudinal view, partly in section, of the embodiment of the invention shown in FIG. 3.

In the second embodiment of the invention shown in FIGS. 3 and 4, the device 10, as described above, includes, in addition, an inlet end, indicated generally at 30, and an outlet end, indicated generally at 31. The inlet end 30 includes a third enclosure 35 that defines a third passageway 32 that has the configuration of a truncated cone with a truncated end 33 and a base end 34. The cross-sectional area of the base end 34 of the third passageway 32 is approximately equal to the cross-sectional area of the opening 13 in the entry end 14. The third enclosure 35 at the base end 34 of the third passageway 32 is connected to the second enclosure 17 so that the base end 34 of the third passageway 32 adjoins the opening 13 in the entry end 14 in a face-to-face relationship. The inlet end 30 also includes a fourth enclosure 36 that defines a fourth passageway 37 having the configuration of a cylinder. One end 38 of the fourth enclosure 36 is connected to the third enclosure 35 at the truncated end 33 of the third passageway 32 so that the fourth passageway 37 and the truncated end of the third passageway adjoin one another in a face-to-face relationship. The other end 39 of the fourth enclosure 36 is adapted to be connected to the engine, such as by the use of ring clamps, for example, whereby the outlets in the engine are placed into fluid communication with the opening 13 in the entry end 14 of the device.

The outlet end 31 of the second embodiment of the invention includes a fifth enclosure 40 that defines a fifth passageway 41 that has the configuration of a truncated cone with a truncated end 42 and a base end 43. The second enclosure 17 and the fifth enclosure 40 at the base end 43 of the fifth passageway 41 are connected to one another so that the base end 43 of the fifth passageway 41 adjoins the opening 15 in the exit end 16 of the device in a face-to-face relationship. A sixth enclosure 44 defines a sixth passageway 45 having the configuration of a cylinder. One end 46 of the sixth enclosure 44 is connected to the fifth enclosure 40 at the truncated end 42 of the fifth passageway 41 so that the sixth passageway 45 and the truncated end 42 of the fifth passageway 41 adjoin one another in a face-to-face relationship.

The dimensional relationships described above with respect to the first embodiment of the invention shown in FIGS. 1 and 2 are also applicable to the second embodiment of the invention shown in FIGS. 3 and 4. Other considerations that are relevant because of the incorporation into the device of the inlet end 30 and the outlet end 31 are as follows: The conical passageway 32 allows for the smooth expansion of the exhaust flow generated by the flow pulses, thereby reducing flow losses, and efficiently focuses reflected pressure pulses back to the outlets in the engine. In this connection, a conical passageway having a large included angle at the connecting points of the enclosures 17 and 35 is preferred, although the environment in which the device is installed may not be large enough to allow for such an arrangement. The conical passageways 32 and 41 at the inlet end 30 and the outlet end 31, respectively, also provide for physically strong joints where they are connected to other components of the device of the invention. By providing an inlet end 30, full expansion of the flow and pressure pulses are encouraged before the pulses reach the opening 13 in the entry end 14 of the device.

As will be understood, the inlet end 30 serves, essentially, as an adapter for attaching the device to the engine and can take other forms. For example, the third enclosure 35 having a conical passageway 32 can be replaced with an enclosure that has a cylindrical passageway that is of approximately the same diameter as the diameter of the opening 13. This type of structure can facilitate the installation of the device of the invention on an internal combustion engine used in certain environments. Additionally, the outlet end 31 can be of a different configuration than as shown in FIGS. 3 and 4.

Figure 5:
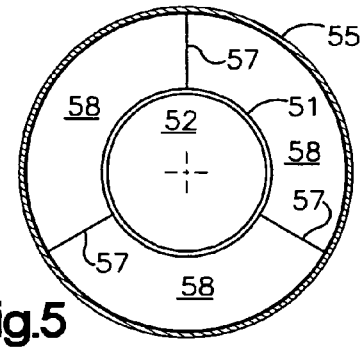
FIG. 5 is an end view, partly in section, of a third embodiment of the invention.
Figure 6:
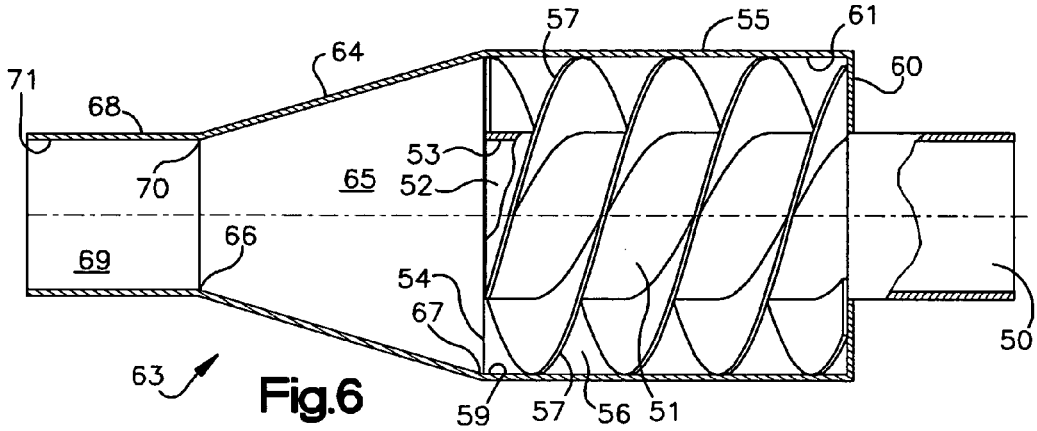
FIG. 6 is a longitudinal view, partly in section, of the embodiment of the invention shown in FIG. 5.

Referring now to FIGS. 5 and 6 of the drawings, there is shown a third embodiment of the invention. In this third embodiment, as with the first and second embodiments, there is a first enclosure 51 that defines a first passageway 52 that has the configuration of a cylinder with one end 53 located at the opening 54 in the entry end 59 of the device and the other end forming the opening 50 in the exit end 61 of the device. Also, as with the first and second embodiments, the third embodiment includes a second enclosure 55 arranged concentrically around and spaced from the first enclosure to create an annular space 56 between the exterior of the first enclosure 51 and the interior of the second enclosure 55. Additionally, means in the form of vanes 57 are located in the annular space 56 for establishing at least one second passageway in the form of a helical passageway in the annular space 56. In the third embodiment of the invention, as illustrated in FIGS. 5 and 6, three substantially identical helical passageways 58 are provided. The helical passageways extend between the opening 54 in the entry end 59 of the device and the reflecting member in the form of the annulus 60.

In the third embodiment, shown in FIGS. 5 and 6, unlike the first and second embodiments, the reflecting member 60 closes off entirely the second passageways 58 at the exit end 61 of the device from the passage of pressure and flow pulses past the reflecting member. Thus, as can be seen in FIGS. 5 and 6, the annulus 60 is attached to the enclosure 55 along its entire outer circumference and to the enclosure 51 along its entire inner circumference. At the same time, the enclosure 51 extends at least to the annulus 60 and, preferably, the enclosure 51 extends beyond the annulus 60 as shown in FIG. 6. As a result, the first passageway 52 forms the opening 50 in the exit end 61 of the device through which all the energy and exhaust products generated by the engine pass.

The third embodiment of the invention also includes an inlet end, indicated generally at 63. The inlet end 63 is similar to the inlet end 30 of the second embodiment of the invention. In other words, the inlet end 63 includes a third enclosure 64 that defines a third passageway 65 that has the configuration of a truncated cone with a truncated end 66 and a base end 67. The cross-sectional area of the base end 67 is approximately equal to the cross-sectional area of the opening 54 in the entry end 59 of the device, and the third enclosure 64 at the base end 67 of the third passageway 65 and the second enclosure are connected to one another so that the base end 67 of the third passageway 65 adjoins the opening 54 in the entry end 59 of the device in a face-to-face relationship. A fourth enclosure 68 defines a fourth passageway 69 having the configuration of a cylinder. One end 70 of the fourth enclosure 68 is connected to the third enclosure 64 at the truncated end 66 of the third passageway 65 so that the fourth passageway 69 and the truncated end 66 of the third passageway 65 adjoin one another in a face-to-face relationship. The other end 71 of the fourth enclosure 68 is adapted to be placed into fluid communication with the engine whereby the cylinder outlets in the engine are placed into fluid communication with the opening 54 in the entry end 59 of the device. The cross-sectional areas of the fourth passageway 69 and the first passageway 52, preferably, are approximately equal so that the exhaust flow is no more than minimally restricted and the creation of an undesirably large back pressure is avoided.

As illustrated in FIG. 6, the enclosure 64 has an extended length compared to the length of the enclosure 35 of the second embodiment of the invention illustrated in FIG. 4. As was noted in the discussion above concerning the second embodiment, a longer conical section in the inlet end of the device allows for a smoother and more complete expansion of the pressure pulses before they reach the entry end of the device. Additionally, the longer conical passageway can more efficiently focus to the outlets in the engine, for tuning purposes, the pressure pulses reflected from the reflecting member 60. However, as has been noted, space limitations may preclude providing a conical passageway of the ideal length.

It will be understood from the foregoing description that the first enclosure 51 comprises means defining a first passageway 52 for a first portion of each pressure and flow pulse extending from the opening 54 in the entry end 59 of the device to the exit end of the device and forming the opening 50 in the exit end of the device. It will also be understood that the second enclosure 55 arranged concentrically around and spaced from the first enclosure 51 to create an annular space 56 between the exterior of the first enclosure 51 and the interior of the second enclosure 55 together with the means in the form of vanes 57 located in the annular space 56 between the first and second enclosures for establishing in the annular space at least one second passageway in the form of a helical passageway comprise means defining at least one second passageway for a second portion of each pressure pulse, the at least one second passageway extending between the opening in the entry end of the device and the reflecting member 60.

Figure 7:
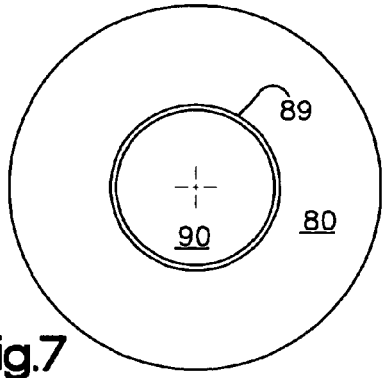
FIG. 7 is an end view of a fourth embodiment of the invention.
Figure 8:
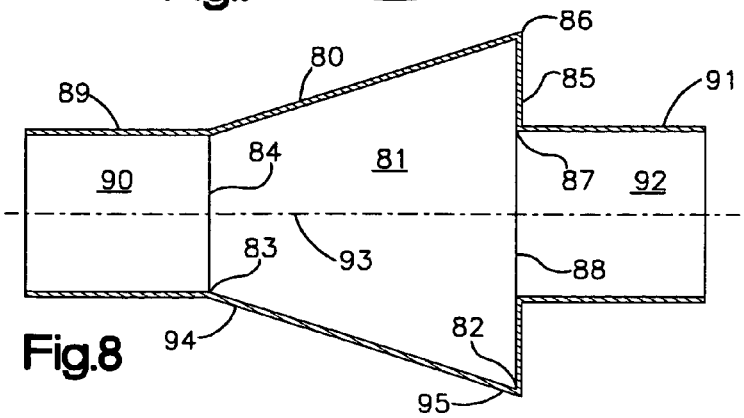
FIG. 8 is a longitudinal cross-sectional view of the embodiment of the invention shown in FIG. 7.

A fourth embodiment of the invention is shown in FIGS. 7 and 8. In the fourth embodiment, the device includes a first enclosure 80 that defines a first passageway 81 that has the configuration of a truncated cone with a base end 82 and a truncated end 83. The truncated end 83 of the passageway 81 comprises the opening 81 for the entry end 94 of the device. The reflecting member for the fourth embodiment comprises an annulus 85 that has an outer circumference 86 and an inner circumference 87. The annulus 85, along its outer circumference 86, is attached to the enclosure 80 at the base end 82 of the first passageway 81, and the inner circumference 87 of the annulus 85 forms the opening 88 in the exit end 59 of the device.

The fourth embodiment of the invention, as illustrated in FIGS. 7 and 8, also includes a second enclosure 89 that defines a second passageway 90 that has the configuration of a cylinder with a cross-sectional area that is preferably equal to the cross-sectional area of the opening 84 in the entry end 94 of the device. The second enclosure 89 is connected at one end to the first enclosure at the truncated end 83 of the first passageway 81 so that the second passageway 90 provides for fluid communication between the engine and the opening 84 in the entry end 94 of the device. A third enclosure 91 defines a third passageway 92 that has the configuration of a cylinder with a cross-sectional area that is preferably equal to the cross-sectional area of the opening 88 in the exit end 95 of the device. The third enclosure 91 is connected to the inner circumference 87 of the annulus 85 so that the third passageway 92 provides for fluid communication from the opening 88 in the exit end 95 of the device away from the device.

As best seen in FIG. 8, the first passageway 81 has a central axis 93 that extends between the center of the opening 84 in the entry end of the device 94 and the center of the opening 88 in the exit end 95 of the device. Although the annulus 85 may be arranged so as to be slightly inclined to the central axis 93, in the embodiment illustrated in FIGS. 7 and 8, the annulus is arranged at right angles around the central axis 93.

In a preferred embodiment, the diameter of the base end 82 of the first passageway 81 is large enough to allow for the full expansion of the pressure pulses. Also in a preferred embodiment, the cross-sectional area of the opening 84 in the entry end 94 of the device is equal to the cross-sectional area of the opening 88 in the exit end 95 of the device.

The foregoing descriptions of the invention are intended to enable a person skilled in the art to practice the invention. It is not intended to detail herein all possible modifications and variations of the invention that will be apparent to those skilled in the art upon reading the description. It is intended, however, that all modifications and variations be included within the scope of the invention as defined in the claims below.

What is claimed is:

1. A device adapted to be connected to a source of pressure pulses and flow pulses so as to receive and regulate the pressure pulses and flow pulses, the device including: an entry end with an opening therein adapted to be placed in fluid communication with one or more outlets in the source from which the pressure pulses and flow pulses are emitted, and an exit end with an opening therein in fluid communication with the opening in the entry end of the device and allowing for the discharge from the device of the pressure pulses and flow pulses generated by the source after the pressure pulses and flow pulses generated by the source have passed through the device; and a reflecting member located in the device so as to reflect at least a portion of each pressure pulse, whereby the noise generated by the pressure pulses is attenuated, the reflecting member adapted to be spaced from at least one of the one or more outlets a distance such that the at least a portion of each pressure pulse that is reflected by the reflecting member is reflected as an expansion wave back through the opening in the entry end of the device to the one or more outlets in the source such that the expansion wave arrives at the one or more outlets while at least a portion of a flow pulse is being emitted from the one or more outlets.

2. The device of claim 1 including:

means defining a first passageway for a first portion of each pressure and flow pulse, the first passageway extending between the opening in the entry end of the device and a location adjacent the opening in the exit end of the device; and means defining at least one second passageway for a second portion of each pressure and flow pulse, the at least one second passageway extending between the opening in the entry end of the device and a location adjacent the opening in the exit end of the device and being longer than the first passageway, whereby the first portion of each pressure pulse that enters the first passageway arrives at the opening in the exit end of the device before any fraction of the second portion of that same pressure pulse that enters the second passageway arrives at the opening in the exit end of the device and the first portion of each flow pulse that enters the first passageway arrives at the opening in the exit end of the device before the second portion of that same flow pulse that enters the second passageway arrives at the opening in the exit end of the device.

3. The device of claim 2 wherein:

the means defining a first passageway comprises a first enclosure and the first passageway has the configuration of a cylinder; and the means defining at least one second passageway includes a second enclosure arranged concentrically around and spaced from the first enclosure to create an annular space between the exterior of the first enclosure and the interior of the second enclosure and means located in the annular space between the first and second enclosures for establishing in the annular space at least one second passageway in the form of a helical passageway.

4. The device of claim 3 wherein the reflecting member comprises an annulus having an outer circumference and an inner circumference, the annulus being attached along its outer circumference to the second enclosure at the exit end of the device, whereby the inner circumference of the annulus comprises the opening in the exit end of the device.

5. The device of claim 2 wherein the total cross-sectional area of the at least one second passageway is approximately three times the cross-sectional area of the first passageway.

6. The device of claim 3 wherein the total cross-sectional area of the at least one second passageway is approximately three times the cross-sectional area of the first passageway.

7. The device of claim 2 wherein the total flow area of the at least one second passageway is approximately equal to the flow area of the first passageway.

8. The device of claim 3 wherein the total flow area of the at least one second passageway is approximately equal to the flow area of the first passageway.

9. The device of claim 7 wherein the first passageway and the at least one second passageway terminate and merge short of the annulus.

10. The device of claim 8 wherein the first passageway and the at least one second passageway terminate and merge short of the annulus.

11. The device of claim 9 wherein the first passageway and the at least one second passageway terminate and merge short of the annulus by a distance at least sufficiently great so as not to impede flow from the at least one second passageway to the opening in the exit of the device.

12. The device of claim 10 wherein the first passageway and the at least one second passageway terminate and merge short of the annulus by a distance at least sufficiently great so as not to impede flow from the at least one second passageway to the opening in the exit of the device.

13. The device of claim 3 including a third enclosure defining a third passageway having the configuration of a truncated cone having a truncated end and a base end, the cross-sectional area of the base end of the third passageway being approximately equal to the cross-sectional area of the opening in the entry end of the device, and the second enclosure and the third enclosure at the base end of the third passageway being connected to one another so that the base end of the third passageway adjoins the opening in the entry end of the device in a face-to-face relationship;

a fourth enclosure defining a fourth passageway having the configuration of a cylinder, one end of the fourth enclosure being connected to the third enclosure at the truncated end of the third passageway so that the fourth passageway and the truncated end of the third passageway adjoin one another in a face-to-face relationship, the other end of the fourth enclosure being adapted to be put into fluid communication with the source whereby the outlets in the source are placed into fluid communication with the opening in the entry end of the device;

a fifth enclosure defining a fifth passageway having the configuration of a truncated cone having a truncated end and a base end, the second enclosure and the fifth enclosure at the base end of the fifth passageway being connected to one another so that the base end of the fifth passageway adjoins the opening in the exit end of the device in a face-to-face relationship; and a sixth enclosure defining a sixth passageway having the configuration of a cylinder, one end of the sixth enclosure being connected to the fifth enclosure at the truncated end of the fifth passageway so that the sixth passageway and the truncated end of the fifth passageway adjoin one another in a face-to-face relationship.

14. The device of claim 13 wherein the reflecting member comprises an annulus having an outer circumference and an inner circumference, the annulus being attached along its outer circumference to the second enclosure at the exit end of the device whereby the inner circumference of the annulus comprises the opening in the exit end of the device.

15. The device of claim 14 wherein the total cross-sectional area of the at least one second passageway is approximately three times the cross-sectional area of the first passageway.

16. The device of claim 15 wherein the total flow area of the at least one second passageway is approximately equal to the flow area of the first passageway.

17. The device of claim 16 wherein the first passageway and the at least one second passageway terminate and merge short of the annulus.

18. The device of claim 17 wherein the cross-sectional area of the first passageway and the cross-sectional area of the opening in the exit end of the device are approximately equal.

19. The device of claim 18 wherein the first passageway and the at least one second passageway terminate short of the annulus by a distance at least sufficiently great so as not to impede flow from the at least one second passageway to the opening in the exit of the device.

20. The device of claim 19 wherein the cross-sectional area of the first passageway is equal to or less than the cross-sectional area of the opening at the exit end of the device.

21. The device of claim 20 wherein the cross-sectional area of the sixth passageway is larger than the cross-sectional area of the opening in the exit end of the device.

22. The device of claim 21 wherein the cross-sectional area of the fourth passageway and the cross-sectional area of the sixth passageway are approximately equal.

23. The device of claim 1 including:

means defining a first passageway for a first portion of each pressure and flow pulse, the first passageway extending from the opening in the entry end of the device to the exit end of the device and forming the opening in the exit end of the device;

means defining at least one second passageway for a second portion of each pressure and flow pulse, the at least one second passageway extending between the opening in the entry end of the device and the reflecting member; and wherein the reflecting member closes off entirely the at least one second passageway from the passage of pressure and flow pulses past the reflecting member.

24. The device of claim 23 wherein:

the means defining a first passageway comprises a first enclosure and the first passageway has the configuration of a cylinder; and the means defining at least one second passageway includes a second enclosure arranged concentrically around and spaced from the first enclosure to create an annular space between the exterior of the first enclosure and the interior of the second enclosure and means located in the annular space between the first and second enclosures for establishing in the annular space at least one second passageway in the form of a helical passageway.

25. The device of claim 24 including:

a third enclosure defining a third passageway having the configuration of a truncated cone having a truncated end and a base end, the cross-sectional area of the base end of the third passageway being approximately equal to the cross-sectional area of the opening in the entry end of the device, the second enclosure and the third enclosure at the base end of the third passageway being connected to one another so that the base end of the third passageway adjoins the opening in the entry end of the device in a face-to-face relationship; and a fourth enclosure defining a fourth passageway having the configuration of a cylinder, one end of the fourth enclosure being connected to the third enclosure at the truncated end of the third passageway so that the fourth passageway and the truncated end of the third passageway adjoin one another in a face-to-face relationship, the other end of the fourth enclosure being adapted to be placed into fluid communication with the source whereby the outlets in the source are placed into fluid communication with the opening in the entry end of the device.

26. The device of claim 25 wherein the cross-sectional area of the first passageway is approximately equal to the cross-sectional area of the fourth passageway.

27. The device of claim 1 including a first enclosure defining a first passageway having the configuration of a truncated cone having a base end and a truncated end, the truncated end of the passageway comprising the opening in the entry end of the device; and the reflecting member of the device comprising an annulus having an outer circumference and an inner circumference, the annulus being attached along its outer circumference to the enclosure at the base end of the first passageway and the inner circumference of the annulus forming the opening in the exit end of the device.

28. The device of claim 27 wherein the cross-sectional area of the opening in the entry end of the device is approximately equal to the cross-sectional area of the opening in the exit end of the device.

29. The device of claim 28 wherein the first passageway has a central axis extending from the center of the opening in the entry end of the device to the center of the opening in the exit end of the device and the annulus is arranged at right angles around the central axis.

30. The device of claim 27 wherein the diameter of the base end of the first passageway is large enough to allow for the full expansion of the compressive pressure pulse.

31. The device of claim 29 wherein the diameter of the base end of the first passageway is large enough to allow for the full expansion of the compressive pressure pulse.

32. The device of claim 29 wherein the diameter of the base end of the first passageway is large enough to allow for the full expansion of the compressive pressure pulse.

33. The device of claim 27 including:

a second enclosure defining a second passageway having the configuration of a cylinder with a cross-sectional area approximately equal to the cross-sectional area of the opening in the entry end of the device, the second enclosure being connected to the entry end of the device so that the second passageway provides for fluid communication between the source and the opening in the entry end of the device; and a third enclosure defining a third passageway having the configuration of a cylinder with a cross-sectional area approximately equal to the cross-sectional area of the opening in the exit end of the device, the third enclosure being connected to the inner circumference of the annulus so that the third passageway provides for fluid communication from the opening in the exit end of the device away from the device.

34. The device of claim 33 wherein the cross-sectional area of the opening in the entry end of the device is approximately equal to the cross-sectional area of the opening in the exit end of the device.

35. The device of claim 33 wherein the first passageway has a central axis extending between the center of the opening in the entry end of the device to the center of the opening in the exit end of the device and the annulus is arranged at right angles around the central axis.

36. The device of claim 33 wherein the diameter of the base end of the first passageway is large enough to allow for the full expansion of the compressive pressure pulse.

37. The device of claim 34 wherein the diameter of the base end of the first passageway is large enough to allow for the full expansion of the compressive pressure pulse.

* * * * *

UNITED STATES PATENT AND TRADEMARK OFFICE

CERTIFICATE OF CORRECTION

PATENT NO. : 7,661,509 B2
APPLICATION NO. : 10/890775
DATED : February 16, 2010
INVENTOR(S) : Paul M. Dadd It is certified that error appears in the above-identified patent and that said Letters Patent is hereby corrected as shown below:

In the Specification:

Column 5, Line 12: Insert the words --large enough to-- after the word "be" and before the word "allow"

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,661,509 B2
APPLICATION NO. : 10/890775
DATED : February 16, 2010
INVENTOR(S) : Paul M. Dadd It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1088 days.

Signed and Sealed this

Thirtieth Day of November, 2010

David J. Kappos

David J. Kappos
*Director of the United States Patent and Trademark Office*